US005426344A

United States Patent [19]

Wong et al.

[11] Patent Number: 5,426,344

[45] Date of Patent: Jun. 20, 1995

[54] ELECTRONIC BALLASTS

[75] Inventors: Siew E. Wong, Mount Ousley; Thien S. Yang, Connells Point, both of Australia

[73] Assignee: Ultralite International Pty Limited, New South Wales, Australia

[21] Appl. No.: 192,993

[22] Filed: Feb. 7, 1994

Related U.S. Application Data

[63] Continuation of Ser. No. 875,761, Apr. 29, 1992, abandoned.

[30] Foreign Application Priority Data

Aug. 31, 1990 [AU] Australia ..... PK2084

[51] Int. Cl.[6] ..... H05B 41/14

[52] U.S. Cl. ..... 315/200 R; 315/227 R

[58] Field of Search ..... 315/200 R, 205, 206, 315/227 R, DIG. 5, 241 R

[56] References Cited

U.S. PATENT DOCUMENTS 4,959,591 9/1990 Hirschmann ..... 315/205 X

FOREIGN PATENT DOCUMENTS 1522383 of 0000 Australia .
2708684 4/1984 Australia .
5829486 12/1986 Australia .
5076790 9/1990 Australia .
0205287 12/1986 European Pat. Off. .
9102400 2/1991 European Pat. Off. .
7812616 4/1978 France .
3308407 3/1984 Germany .
1-252175 10/1989 Japan .

*Primary Examiner*—Steven Mottola
*Attorney, Agent, or Firm*—Jacobson & Johnson

[57] ABSTRACT

A ballast circuit for fluorescent lamp which comprises an additional D2 located just after the rectifier bridge D1 and before smoothing capacitors C5, C6. The diode D2 is matched to the value of a mylar capacitor C3 connected across the output of the rectifier bridge and the fluorescent lamp load whereby the fluorescent lamp draws current over substantially the whole of the supply voltage waveform to thereby improve the power factor and reduce the current harmonic distortion.

3 Claims, 3 Drawing Sheets

ELECTRONIC BALLASTS

This application is a continuation of application Ser. No. 07/875,761, Filed Apr. 29, 1992, now abandoned.

This application is a continuation of PCT application PCT/AU91/00402 filed Aug. 29, 1991 titled IMPROVEMENTS IN ELECTRONIC BALLASTS which is a continuation of Australia patent application PK2084 filed Aug. 30, 1990 and titled IMPROVEMENTS IN ELECTRONIC BALLASTS.

This invention relates to electrical apparatus and more particularly although not exclusively to compact ballast circuits for fluorescent lamps of the type used as replacements for incandescent bulbs.

Because of their small size and cost constraints it is not feasible (as with larger fluorescent lamp circuits) to install a low-pass filter at the input of these circuits. As a result the compact ballast circuits presently available have a very high current harmonic distortion and a very low power factor of between 0.45 and 0.6. A typical circuit together with voltage 1 and current 2 waveforms for such existing ballasts is shown in FIGS. 1 and 2. Because of these unfavourable characteristics power authorities in many countries such as Australia will not approve these circuits for sale as separate items. Consequently the regulations can only be complied with if the ballast circuit and fluorescent lamp are sold as a complete one piece unit. This however greatly adds to their cost and reduces consumer acceptance of the product.

It is therefore an object of this invention to ameliorate the aforementioned disadvantages and accordingly an improved circuit is disclosed in which additional diode means is provided to ensure that the lamp draws current from the rectifier bridge over substantially the whole of the supply voltage waveform including periods when this voltage is less than that across smoothing capacitor C4.

One preferred form of this invention will now be described with reference to the attached illustrations in which:

Figure 1:
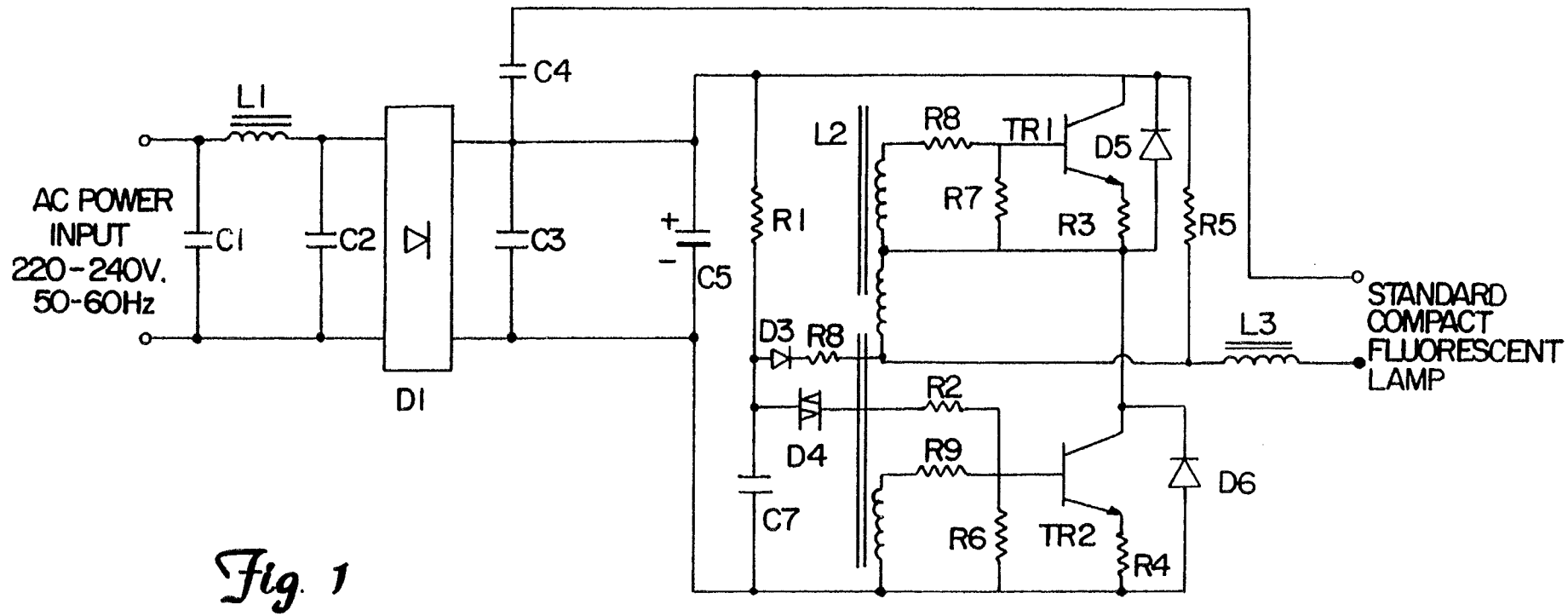
FIG. 1 shows a typical prior art ballast circuit.
Figure 2:
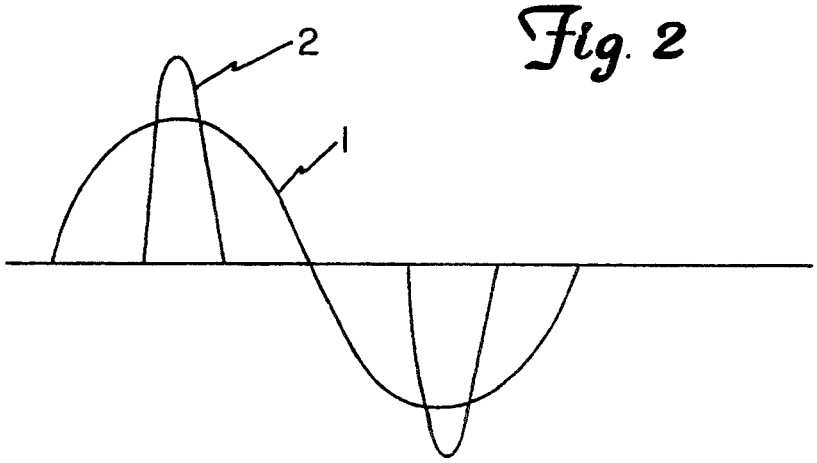
FIG. 2 shows voltage and current waveform.
Figure 3:
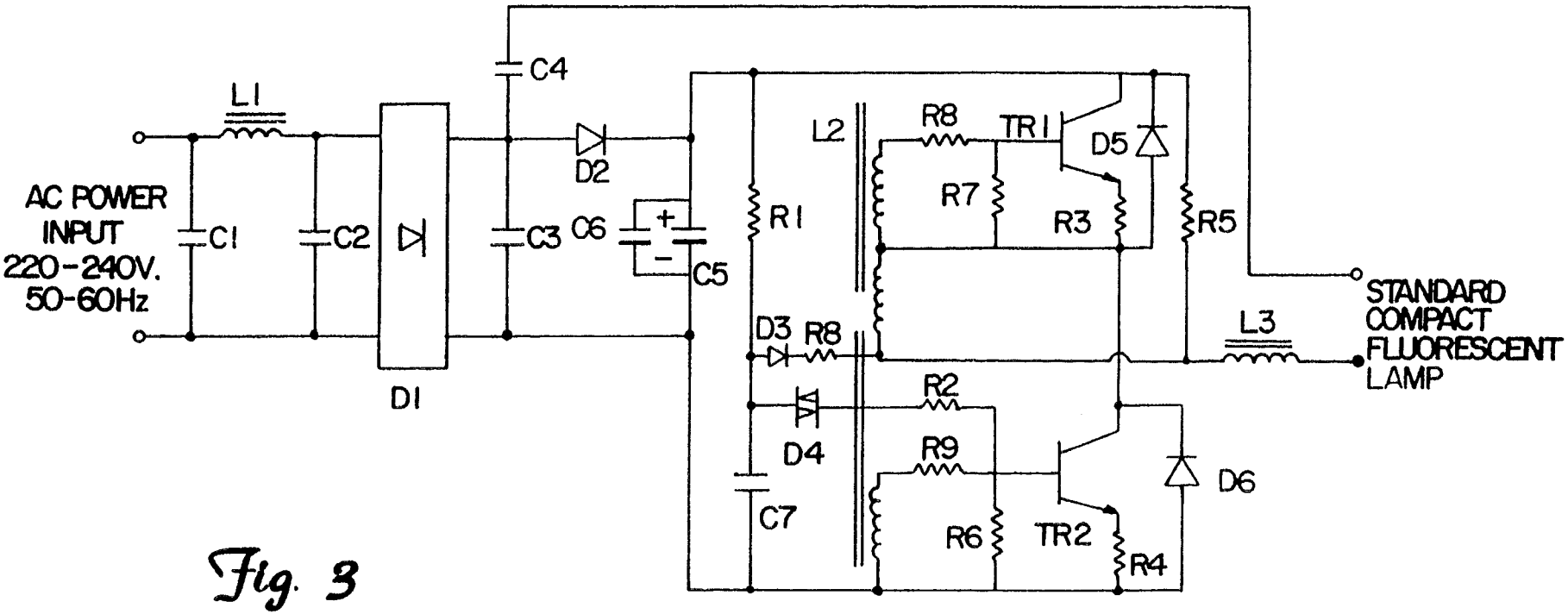
FIG. 3 shows a schematic diagram of a circuit according to the currently preferred form of this invention.

Referring first to FIG. 3 there is shown a ballast circuit which at least in terms of power factor and size has substantial advantages over that of FIG. 1 and is suitable for use with compact fluorescent lamps of 9 to 18 watts such as those sold under part numbers YDN13-2H, YDN13-2U, PLC13/82. DULUX D13W and LYNX D13W. Typical non limiting values for the various components shown may be as follows:

| | |
|---|---|
| C1 = 0.1 μF 250V AC | R1 = 820.0 ohms |
| C2 = 0.006 μF 250V AC | R2 = 20.0 Ohms |
| C3 = 0.006 μF 220V AC | R3 = 3.3 ohms |
| C4 = 0.047 μF 400V DC | R4 = 3.3 ohms |
| C5 = 4.1 μF 400V DC | R5 = 330.0 ohms |
| C6 = 4.7 μF 400V DC | R6 = 68.0 ohms |
| C7 = 0.068 μF 100V DC | R7 = 68.0 ohms |
| | R8 = 5.1 ohms |

-continued

| | |
|---|---|
| | R9 = 5.1 ohms |
| D1 = Bridge Rectifier | L1 = Filter Coil |
| D2, D3, D5 & D6 = Diodes | L3 = Choke Coil |
| D4 = Diac | L5, L2 & L4 = Core Coil |

In this case it will be noted that a diode D2 (preferably of a high speed switching type such as FR104) is inserted into the circuit just after the full wave rectifier bridge D1 and before the smoothing capacitor C5 and C6. Further, the single smoothing capacitor in FIG. 1 has been replaced by two capacitors C5 and C6 to reduce the physical size of the unit. The lamp drive capacitor C4 however remains directly connected to the rectifier bridge output.

Figure 4:
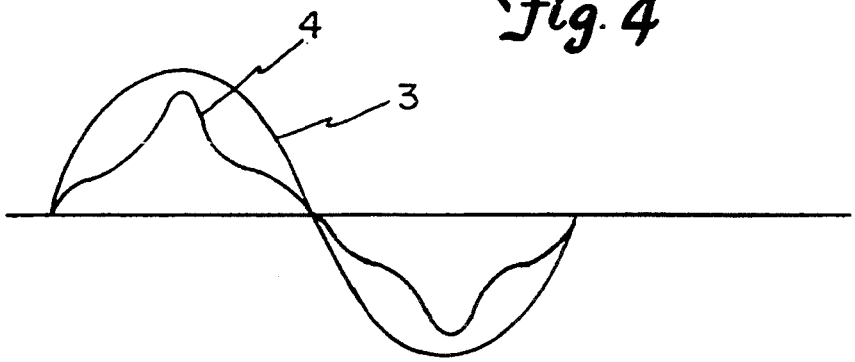
FIG. 4 shows the current waveform produced by the circuit of FIG. 3.

The purpose of this diode is to ensure that the current used by the fluorescent lamp is not entirely supplied by capacitors C5 and C6 during portions of the half cycle when the supply voltage 3 is lower than the DC Voltage on C5, C6. During this period D2 blocks the supply from C5, C6 and allows the lamp to draw current directly from the rectifier bridge. Hence, the current waveform 4 becomes more even as shown in FIG. 4. Although this curve is still not sinusoidal, it does improve the power factor to better than 0.9, and reduce the current harmonic distortion to within the limits set for even large electronic ballasts as set out for example in IEC 555/2 and AS3168).

The value of mylar capacitor C3 has to be modified to match the diode. With this particular embodiment when designed for use with a 13 watt fluorescent lamp it may be 0.047 μF 400 volts.

It will thus be appreciated that this invention at least in the form of the example disclosed provides a novel and useful improvement in ballast circuits for compact fluorescent lamps. Clearly however the embodiment described is only the currently preferred form of this invention and a wide variety of modifications may be made which would be apparent to a person skilled in the art. For example the values of the various components may be changed to adapt the circuit for use with larger fluorescent lamps up to 125 watts for other types of discharge lamps.

The claims defining the invention are as follows; we claim:

1. In a ballast circuit for a fluorescent lamp in which the ballast circuit has a rectifier bridge (D1), a mylar capacitor (C3) across the rectifier bridge and a smoothing capacitance in parallel with the mylar capacitor, the improvement comprising:

an additional diode (D2) have an electrode connected to the junction of the mylar capacitor and the rectifier bridge and the other electrode connected to the smoothing capacitance, said additional diode being a high speed switching type polarized so that during half cycles of the supply voltage when the supply voltage is less than the voltage on the smoothing capacitance, said additional diode blocks current from flowing from the smoothing capacitance to thereby improve the power factor and reduce hamonic distortion of the ballast circuit.

2. The ballast circuit as claimed in claim 1 wherein the smoothing capacitance comprises two capacitors (C5), (C6) to reduce the physical size of the circuit.

3. The ballast circuit as claimed in claim 1 wherein the power factor is improved to better than 0.9.

* * * * *

US005426344B1

REEXAMINATION CERTIFICATE (3093rd)

United States Patent [19] [11] B1 5,426,344

Wong et al. [45] Certificate Issued Dec. 31, 1996

[54] ELECTRONIC BALLASTS

[75] Inventors: Siew E. Wong, Mount Ousley; Thien S. Yang, Connells Point, both of Australia

[73] Assignee: Ultralite International Pty. Limited, Carlton, Australia

Reexamination Request:
No. 90/004,106, Dec. 21, 1995

Reexamination Certificate for:

| | |
|---|---|
| Patent No.: | **5,426,344** |
| Issued: | **Jun. 20, 1995** |
| Appl. No.: | **192,993** |
| Filed: | **Feb. 7, 1994** |

Related U.S. Application Data

[63] Continuation of Ser. No. 875,761, Apr. 29, 1992, abandoned, which is a continuation of PCT/AU91/00402, Aug. 29, 1991.

[30] Foreign Application Priority Data

Aug. 31, 1990 [AU] Australia ..... PK2084

[51] Int. Cl.[6] ..... H05B 41/14

[52] U.S. Cl. ..... 315/200 R; 315/227 R

[58] Field of Search ..... 315/200 R, 205, 315/206, 227 R, 241 R, DIG. 5

[56] References Cited

U.S. PATENT DOCUMENTS

| | | | |
|---|---|---|---|
| 4,511,823 | 4/1985 | Eaton et al. | 315/226 |
| 4,745,539 | 5/1988 | Nilssen | 363/37 |
| 4,782,268 | 11/1988 | Fahnrich et al. | 315/200 |

FOREIGN PATENT DOCUMENTS 2022943 12/1979 United Kingdom .

*Primary Examiner*—Steven J. Mottola

[57] ABSTRACT

A ballast circuit for fluorescent lamp which comprises an additional D2 located just after the rectifier bridge D1 and before smoothing capacitors C5, C6. The diode D2 is matched to the value of a mylar capacitor C3 connected across the output of the rectifier bridge and the fluorescent lamp load whereby the fluorescent lamp draws current over substantially the whole of the supply voltage waveform to thereby improve the power factor and reduce the current harmonic distortion.

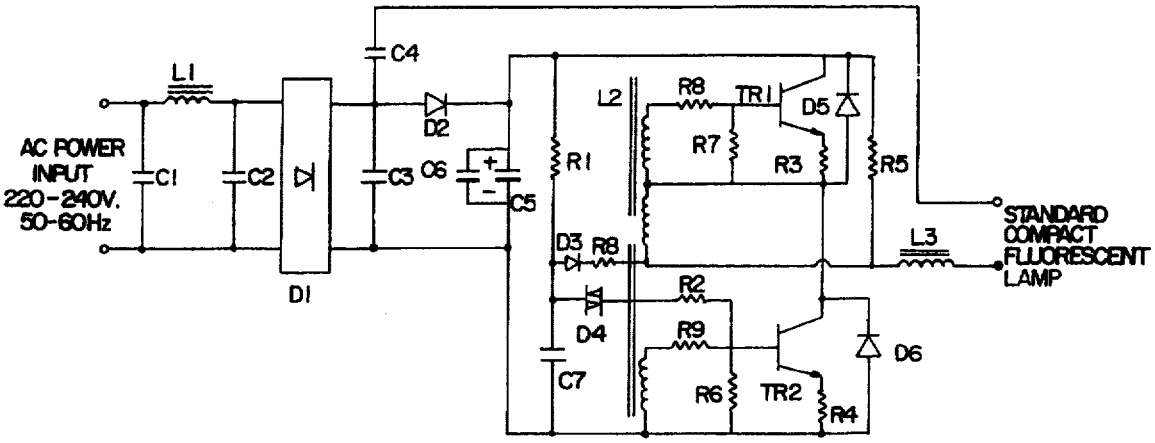

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–3 are cancelled.

* * * * *